US006688909B1

(12) United States Patent
Espenshade et al.

(10) Patent No.: US 6,688,909 B1
(45) Date of Patent: Feb. 10, 2004

(54) STACKED CONNECTOR WITH LEDS

(75) Inventors: Leonard K. Espenshade, Harrisburg, PA (US); Kevin E. Walker, Hershey, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/264,611

(22) Filed: Oct. 3, 2002

(51) Int. Cl.[7] ..... H01R 3/00
(52) U.S. Cl. ..... 439/490; 439/541.5
(58) Field of Search ..... 439/620, 607, 439/676, 941, 608, 76.1, 541.5, 610, 490, 488

(56) References Cited

U.S. PATENT DOCUMENTS 4,978,317 A 12/1990 Pocrass
5,362,257 A 11/1994 Neal et al.
5,797,770 A * 8/1998 Davis et al. ..... 439/607
6,116,946 A 9/2000 Lewis et al.
6,159,039 A 12/2000 Wu
6,162,089 A 12/2000 Costello et al.
6,183,292 B1 2/2001 Chen et al.
6,227,911 B1 5/2001 Boutros et al.
6,474,999 B1 * 11/2002 Givens et al. ..... 439/76.1
6,478,610 B1 * 11/2002 Zhou et al. ..... 439/490
6,585,540 B2 * 7/2003 Gutierrez et al. ..... 439/620

* cited by examiner

*Primary Examiner*—Jean F. Duverne
(74) *Attorney, Agent, or Firm*—Wei Te Chung

(57) ABSTRACT

An electrical connector (1) has a metal shield (3), a main housing (5), a pair of LEDs (6) received in the main housing, a subassembly (7) assembled to the main housing, a stacked Universal Serial Bus (USB) 4, and a molded assembly (2) assembled to the subassembly. The LED (61) has three leads (611), a left free end (612) is longer than a right free end (614), and a middle free end (613) is bent perpendicularly and extending horizontally thereafter below the free ends. The molded assembly comprising a plastic part (24), and a first and second connections (22, 23) insert molded in the plastic part. The free ends of the leads are respectively soldered to soldering sections (221, 231) of the first and second connections.

7 Claims, 11 Drawing Sheets

STACKED CONNECTOR WITH LEDS

CROSS-REFERENCE TO RELATED APPLICATION

This present application is related to a U.S. patent application Ser. No. 10/232,879, invented by Iosif R. Korsunsky et al., filed on Aug. 29, 2002, entitled "MODULAR JACK ASSEMBLY HAVING IMPROVED POSITIONING MEANS"; an unknown serial number, invented by Kevin Eugene Walker and Leonard Kay Espenshade, entitled "STACKED CONNECTOR WITH LEDS"; application Ser. No. 10/234,567 filed Sep. 3, 2002, invented by Leonard Kay Espenshade, entitled "SHIELDED ELECTRICAL CONNECTOR ASSEMBLY HAVING RELIABLE GROUNDING CAPABILITIES"; application Ser. No. 10/236,614 filed Sep. 6, 2002, invented by Leonard Kay Espenshade and Kevin Eugene Walker, entitled "STACKED ELECTRICAL CONNECTOR ASSEMBLY HAVING EASILY DETACHABLE ELECTRONIC MODULE; application Ser. No. 10/236,615 filed Sep. 6, 2002, invented by Leonard Kay Espenshade and Kevin Eugene Walker, entitled "ELECTRICAL CONNECTOR ASSEMBLY HAVING GROUND MEMBER"; and application serial number unknown, invented by Kevin Eugene Walker, James Henry Hylad, Tod Martin Harlan and Robert William Brown, entitled "STACKED CONNECTOR WITH PLASTIC PART ASSEMBLED THERETO" contemporaneously filed and assigned to the common assignee. Copies of the specifications are hereto attached.

BACKGROUND OF THE INVENTION

1. Field of the Invention

The present invention generally relates to an electrical connector, and more particularly to an electrical connector with light-emitting devices (LEDs).

2. Description of the Prior Art

Following the development of network industry, a variety of types of connectors are proposed to meet different requirements. The connectors general have LEDs for indicating full mating of complementary connectors.

U.S. Pat. No. 6,227,911, issued to Boutros on May 8, 2001, discloses an electrical connector having a housing, and two different LED sub-modules. The LED sub-modules have pockets for accommodating LEDs, and grooves for accommodating the leads of the LEDs. The leads of the LEDs extend horizontally before the LED are assembled to the LED sub-modules, and the leads of the LEDs are bent vertically after they are assembled to the LED sub-modules. The leads of the LEDs are soldered to a printed circuit board (PCB) of an outer device. However, the close spacing between the adjacent leads of the LEDs makes a difficult and tedious task to solder them to the PCB, and the solder joints will bridge each other during the soldering process, which will cause electrical short circuiting.

U.S. Pat. No. 4,978,317, issued to Pocrass on Dec. 18, 1990, discloses an electrical connector. The electrical connector of Pocrass has a housing, an LED positioned within the housing, the LED has a plurality of lead wires. The housing has a top wall and a bottom wall, the lead wires of the LED extending along the top wall of the housing, bent perpendicular to the bottom wall and extending through the bottom wall and then plug into a PCB.

However, as the leads of the LEDs of Pocrass patent are bent downwardly to extend through the PCB, as the standard LEDs has a standard length, so the leads of the LEDs can not have enough length to extend through the PCB after they are bent when the connector is a little higher or be stacked with other connectors.

Hence, an improved connector is needed to eliminate the above mentioned defects of the conventional connectors.

BRIEF SUMMARY OF THE INVENTION

The object of the present invention is to provide an electrical connector having a LED with leads on different plane.

An electrical connector of the present invention has an insulative main housing, a bi-color LED and a single color LED, a subassembly having a magnetic assembly and a contact array assembly, a stacked Universal Serial Bus connector (USB), a molded assembly, and a metal shield. The bi-color LED has three leads, the three leads respectively has a left free end, a middle free end and a right free end. The middle free end of the bi-color LED is bent perpendicularly and extends horizontally thereafter below the other leads. The molded assembly comprises a plastic part, and a first and second connections insert molded in the plastic part. The first and second connections have soldering sections for respectively soldered to free ends of the leads of LEDs. The plastic part has a pair of supporting posts extending horizontally on an upper portion thereof. Each supporting post defines a channel, one of the channel receives a middle soldering section of the second connection.

Other objects, advantages and novel features of the invention will become more apparent from the following detailed description of a preferred embodiment when taken in conjunction with the accompanying drawings.

DETAILED DESCRIPTION OF THE INVENTION

Figure 1:
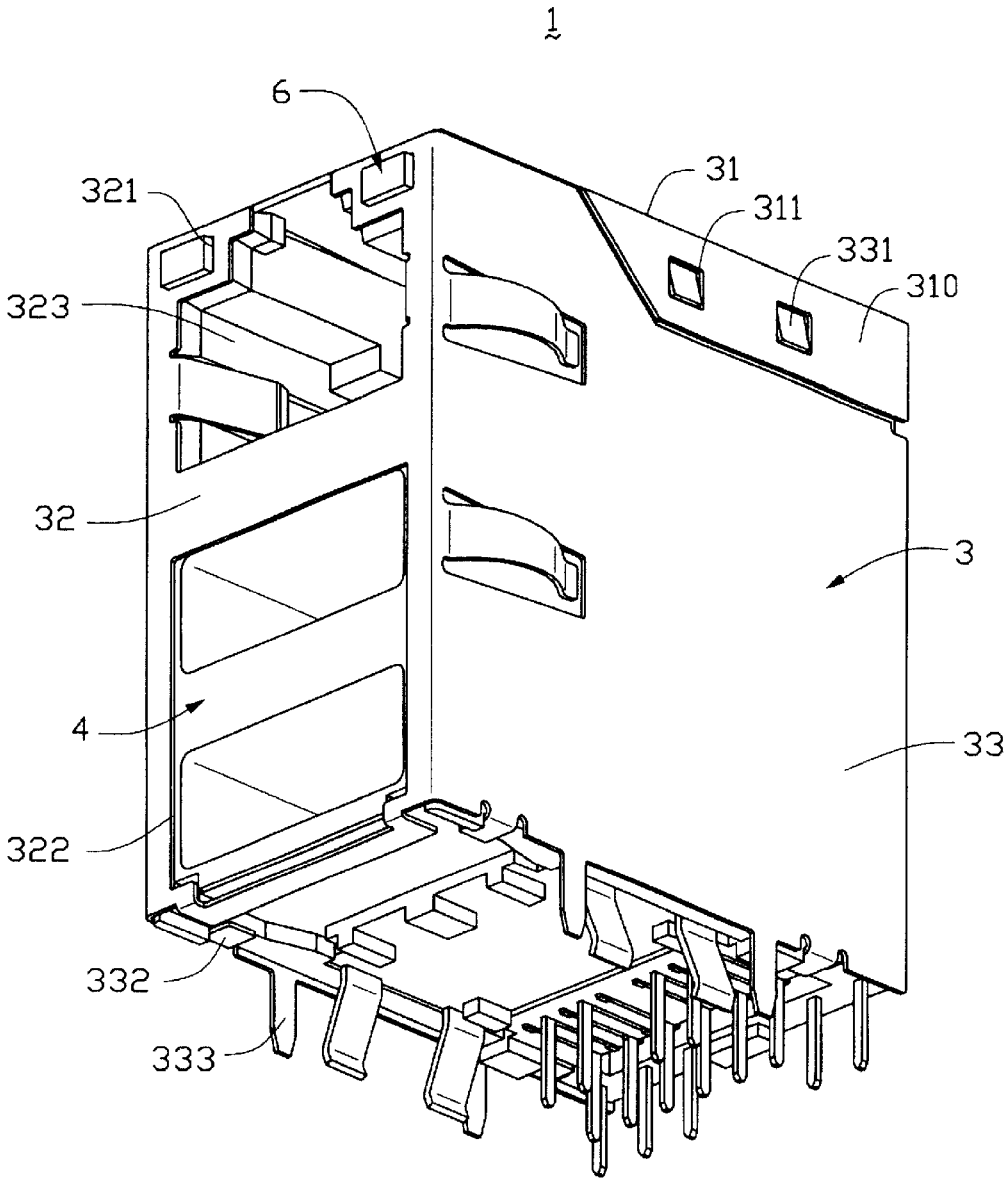
FIG. 1 is a perspective view of an electrical connector of the present invention.
Figure 2:
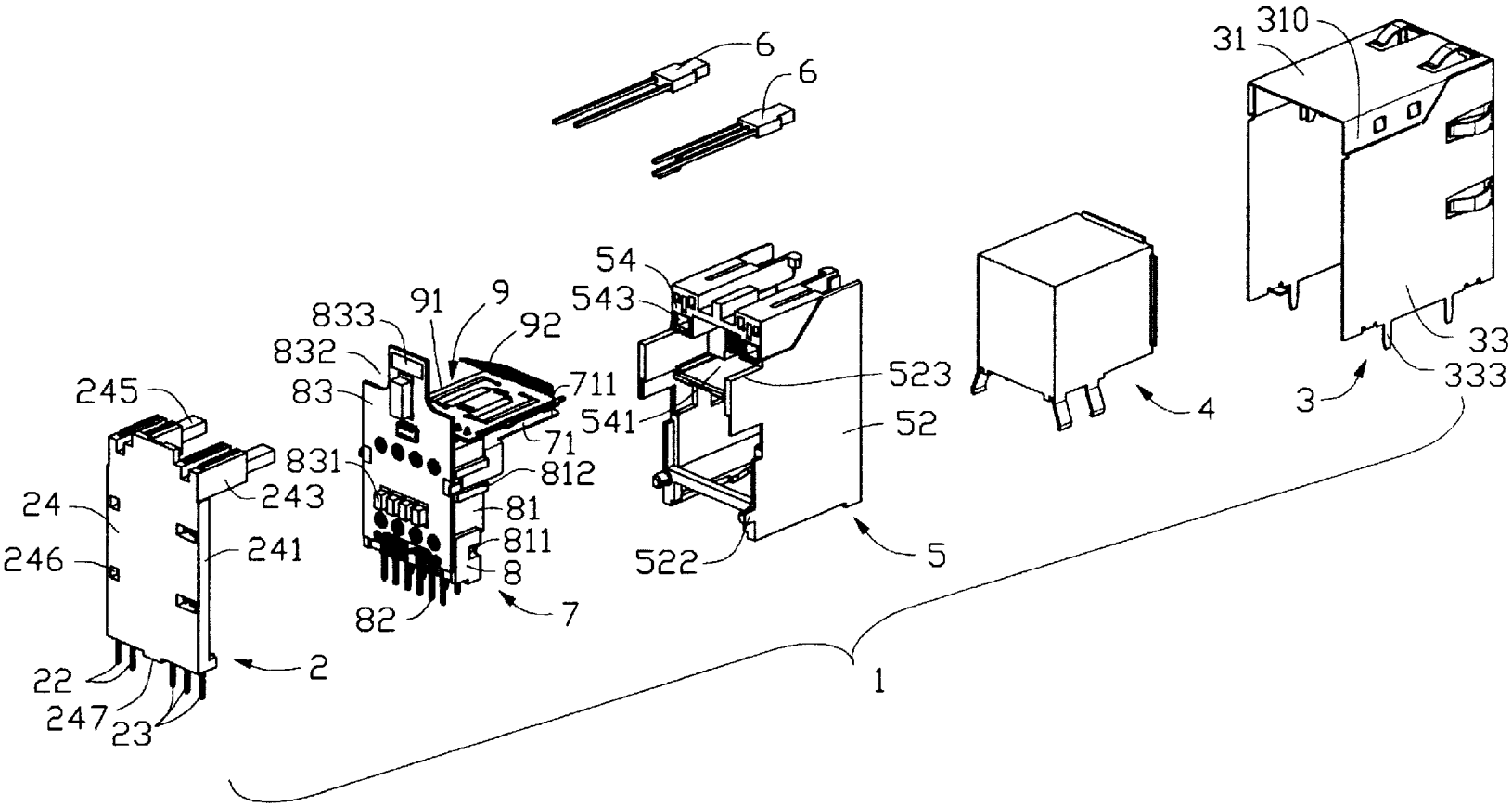
FIG. 2 is an exploded view of FIG. 1.

Referring to FIGS. 1 and 2, an electrical connector 1 of the present invention has a shield 3, a main housing 5, a pair of light-emitting devices (LEDs) 6, a stacked Universal Serial Bus connector (USB) 4, a subassembly 7, and a molded assembly 2.

The shield 3 has a top wall 31, a front wall 32, and two side walls 33. The top wall 31 has a pair of side portions 310 respectively extending from two lateral sides 310. Each lateral side 310 defines a pair of mounting holes 311. Each side wall 33 forms a pair of mounting tabs 331 on an upper portion thereof for engaging with corresponding mounting holes 311 of the top wall 31, and each side wall 33 has a pair of grounding tabs 333 and a pair of retentive tabs 332. The front wall 32 of the shield 3 has a pair of LED receiving cavities 321 on an upper portion thereof, a USB opening 322, and a first opening 323 defined above the USB opening 322.

Figure 3:
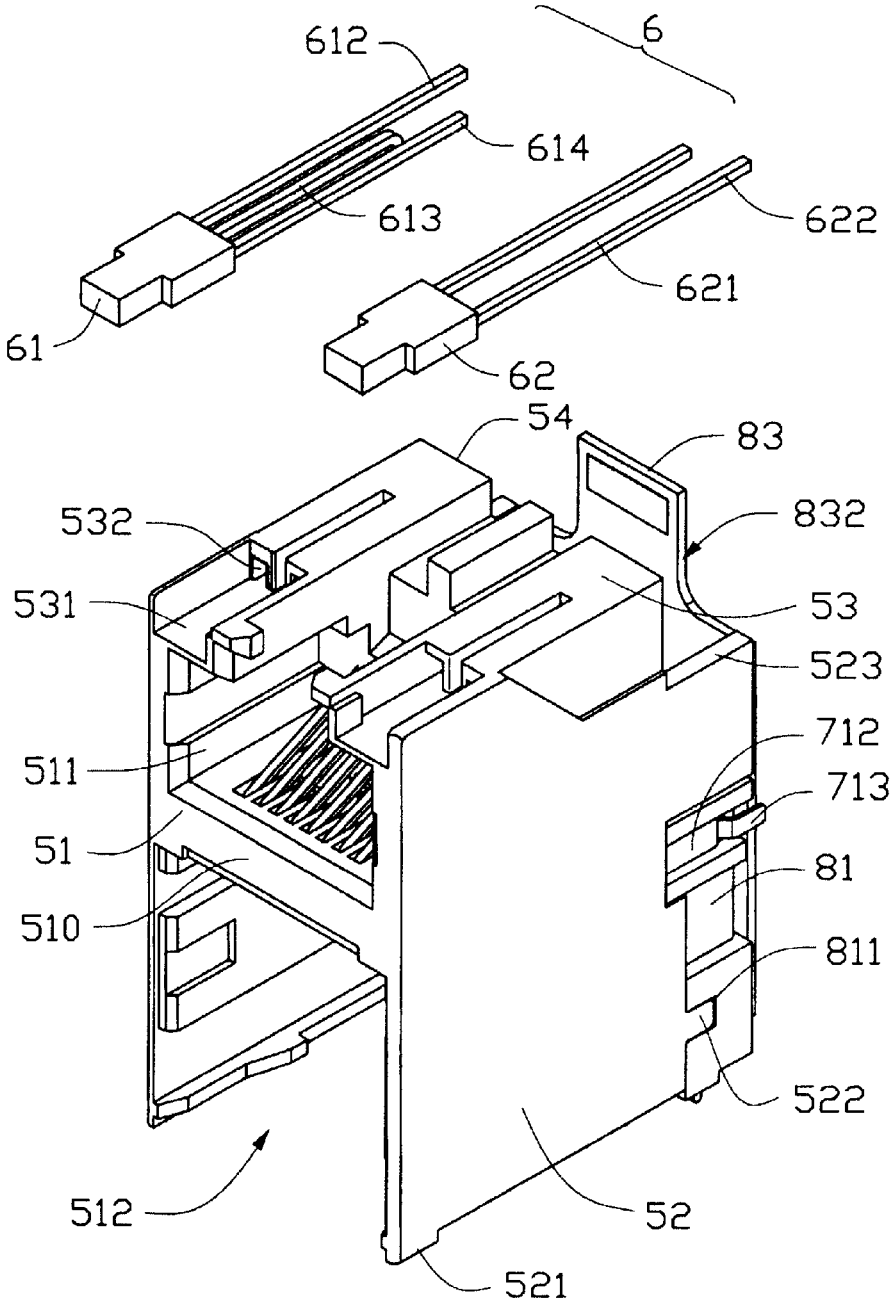
FIG. 3 is a partial assembly view of FIG. 2, with a subassembly and a main housing assembled.

Referring to FIGS. 2 and 3, the main housing 5 is substantially a cubic and has a front wall 51, a pair of side walls 52, a top wall 53 and a rear wall 54. The main housing 5 has a partitioner 510 separating an interior space (not labeled) thereof into a first cavity 511 and a second cavity 512. Each side wall 52 has a standoff 521 extending downwardly from a bottom edge thereof and a locating post 522 extending rearwardly therefrom. The top wall 53 defines a pair of apertures 531 in a front portion thereof and a plurality of passageways 532 communicating with corresponding apertures 531. The rear wall 54 defines a pair of slots 543 respectively adjacent to the side walls 52, and a first groove 541 and a second groove (not shown) respectively above and below the partitioner 510. The side walls 52 of the main housing 5 respectively have bearing portions 523 extending rearwardly from the side walls 52.

The LEDs 6 has a bi-color LED 61 and a single color LED 62. The bi-color LED has three leads 611, the three leads 611 respectively has a left free end 612, a middle free end 613 and a right free end 614. The left free end 612 extends longer than the right free end 614. The middle free end 612 of the middle lead 611 of the bi-color LED 61 is bent perpendicularly and extends parallel to the left and right free ends 612, 613 of the bi-color LED 61 afterward. The single color LED 62 has two leads 621, one lead extends longer than the other.

Figure 7:
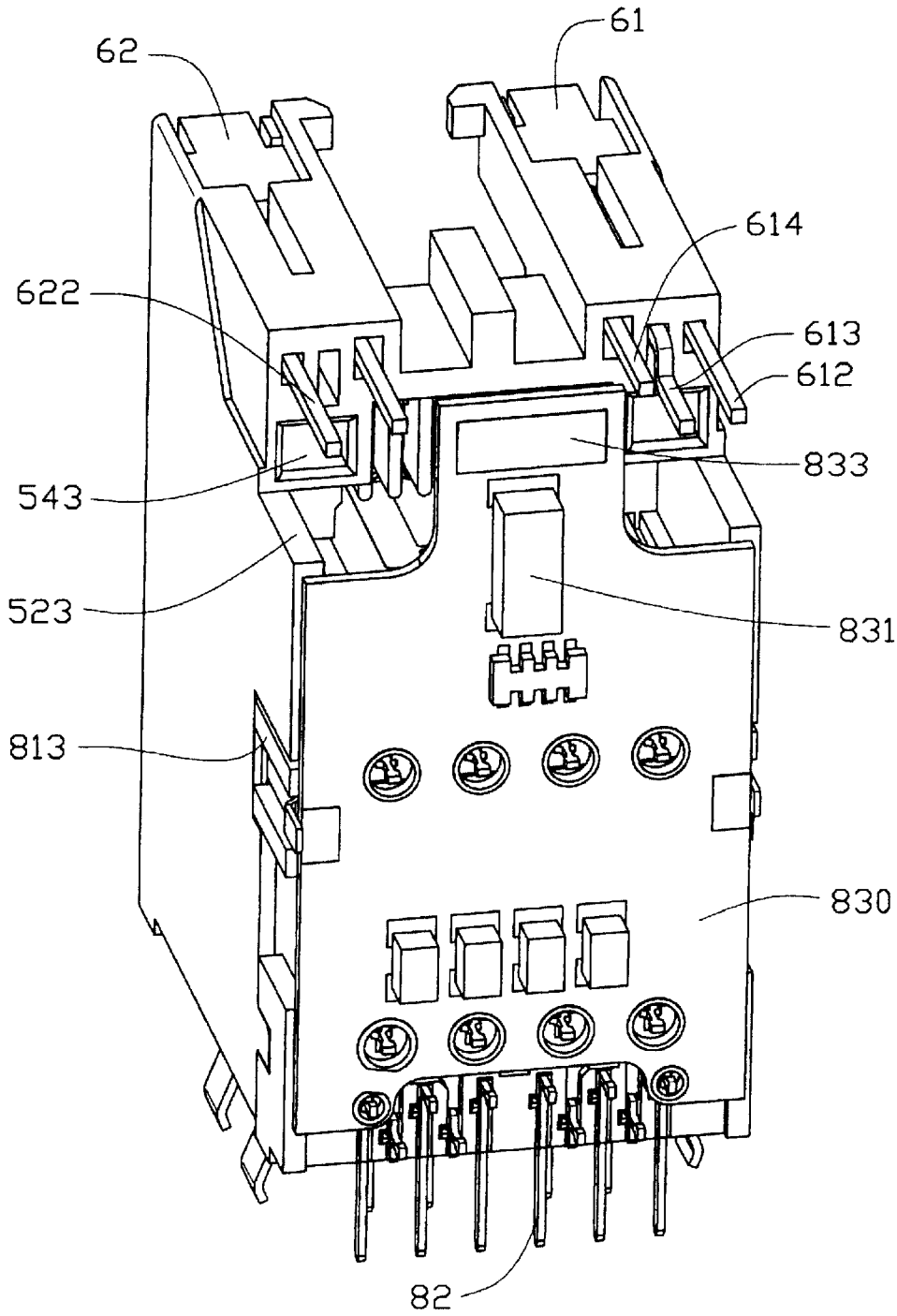
FIG. 7 is a partial assembly view of the electrical connector.
Figure 8:
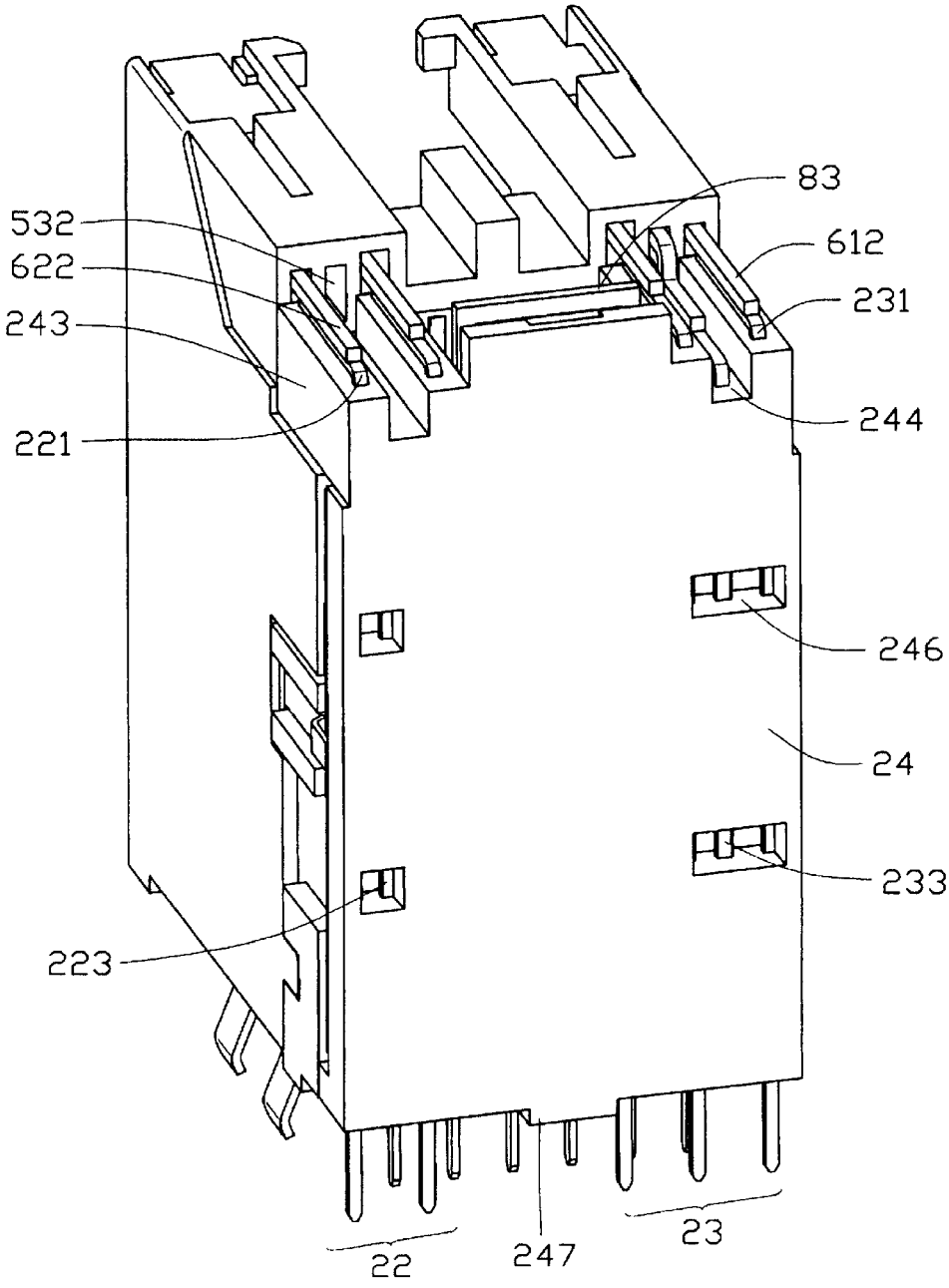
FIG. 8 is another partial assembly view of the electrical connector, wherein a molded subassembly is assembled thereto.
Figure 9:
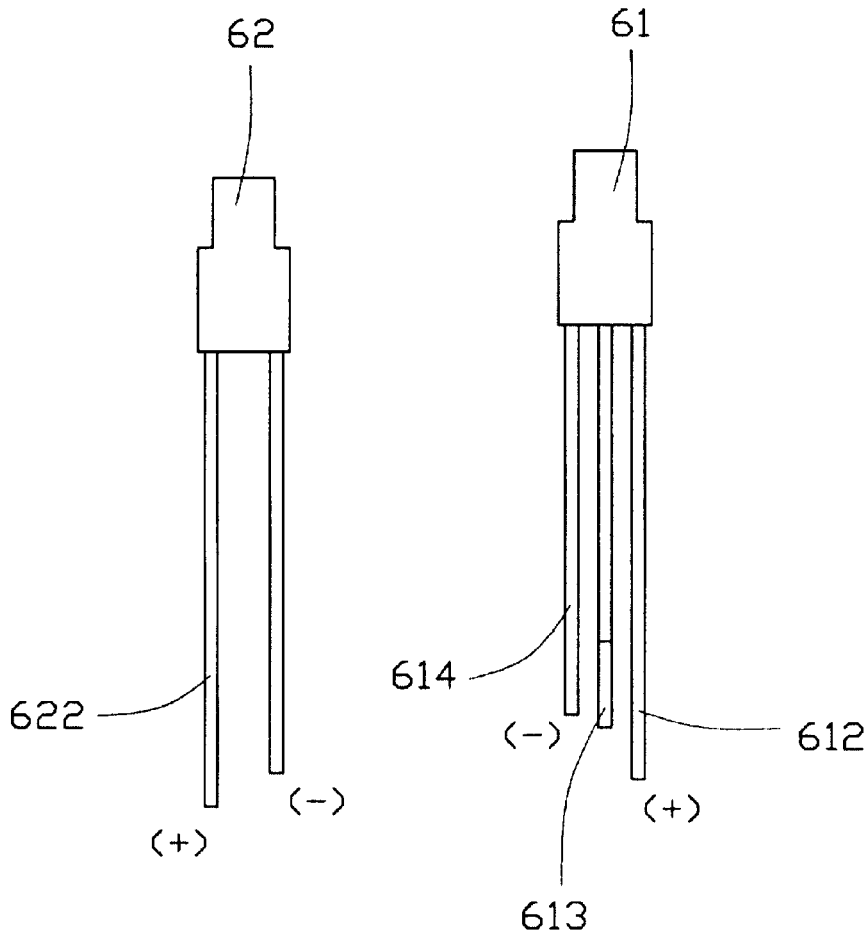
FIG. 9 is a top view of LEDs of the electrical connector of FIG. 2.

The subassembly 7 has a grounding terminal 71, a magnetic assembly 8 and a contact array assembly 9. The grounding terminal 71 has a flat portion 711, a pair of spring fingers (not labeled) formed on the flat portion 711, a pair of engaging portions 712 respectively extending rearwardly from opposite sides of the flat portion 711, and a pair of grounding tails 713 extending from free ends of corresponding engaging portions 712. The magnetic assembly 8 has a first insulative housing 81, a plurality of magnetic coils (not shown) received in an interior space of the first housing 81, a vertical printed circuit board (PCB) 83 assembled to the first housing 81, and a plurality of signal and grounding contacts 82 received in the first housing 81. The first housing 81 has a pair of keys 811 adjacent to a bottom portion thereof, two pairs of ribs 813 (shown in FIG. 7) formed on corresponding lateral sides thereof and a recess 812 defined between each pair of ribs 813. The vertical PCB 83 has a plurality of filtering elements 831 arranged thereon, a pair of cutouts 832 defined in an upper portion of the vertical PCB 83, and a pair of grounding pads 833 respectively formed on opposite surfaces thereof. The engaging portions 712 of the grounding terminal 71 are respectively received in corresponding recesses 812 of the first housing 81, and the grounding tails 713 abut against opposite side edges of the vertical PCB 83 of the magnetic assembly 8, thus the grounding terminal 71 straddles the vertical PCB 83. The contact array assembly 9 has a first PCB 91 and a plurality of terminals 92 soldered to the first PCB 91.

Figure 4A:
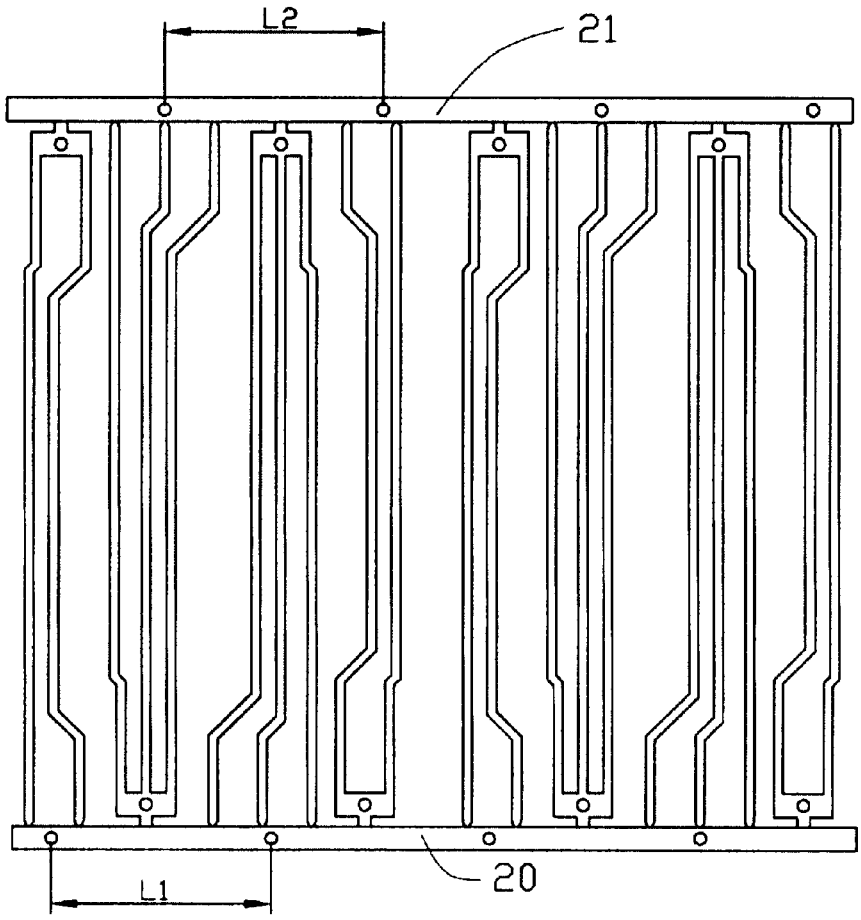
FIGS. 4*a*–4*c* are top views of material strips of connections prior to being assembled to the electrical connector.
Figure 4B:
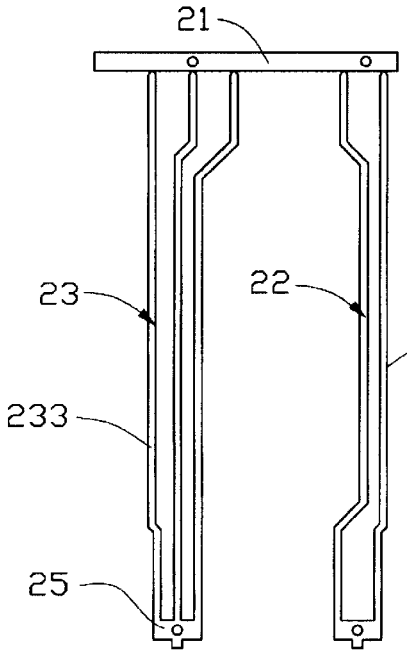
Figure 4C:
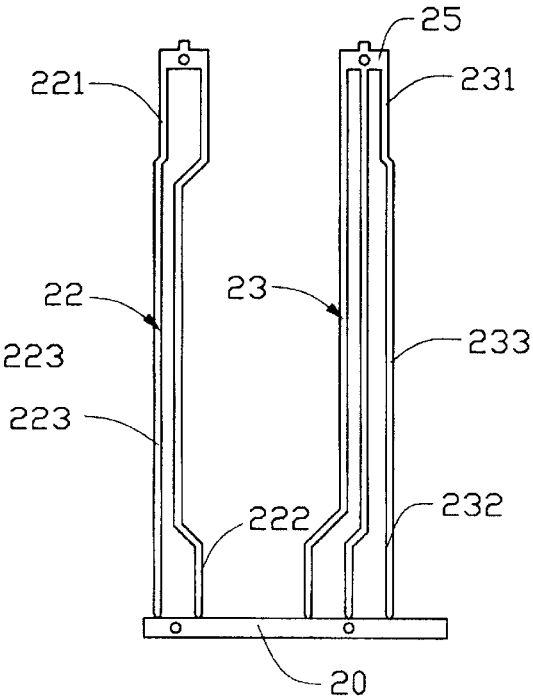
Figure 5:
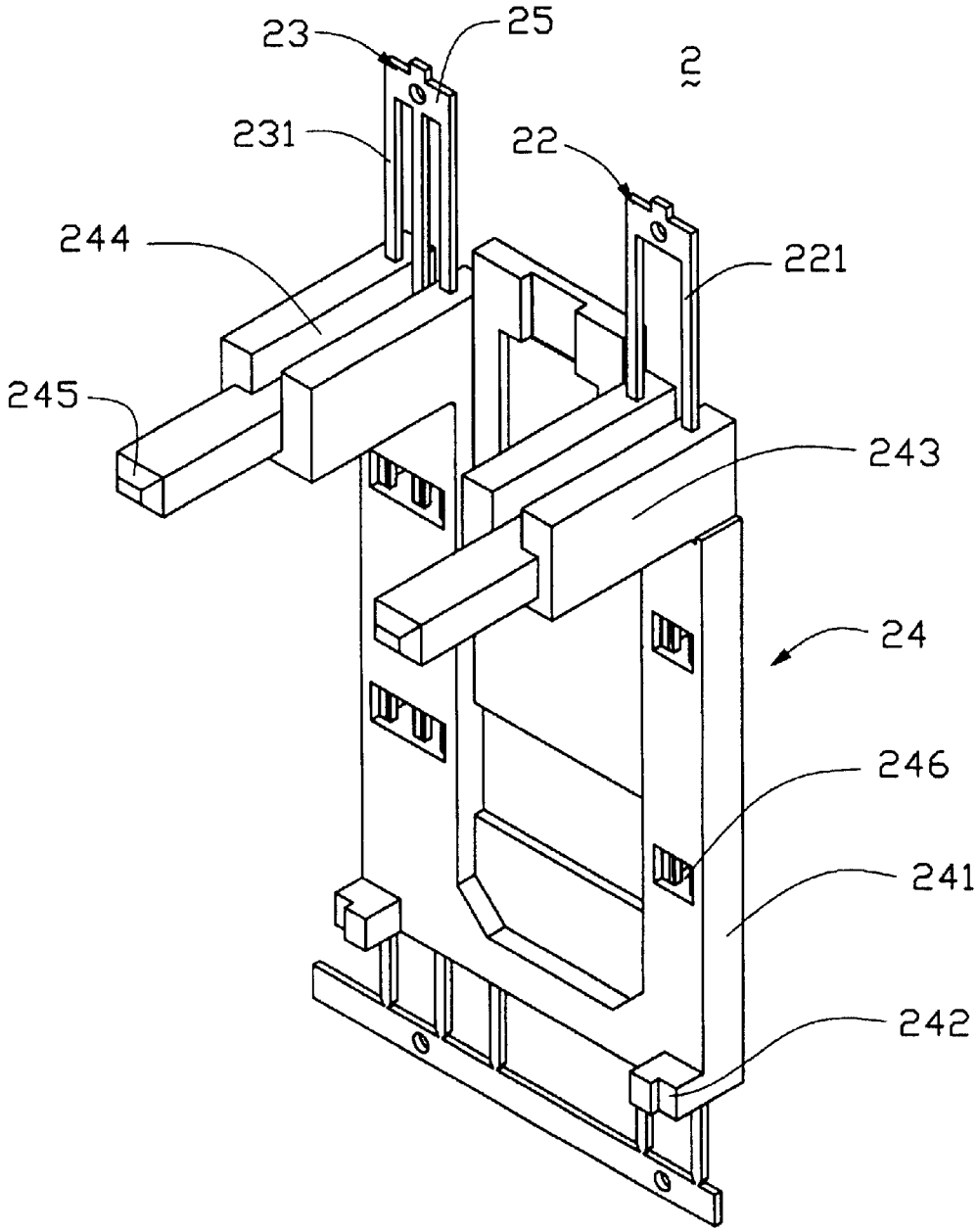
FIG. 5 is a perspective view of a molded assembly of the electrical connector, wherein soldering sections of connections insert molded in the molded assembly are not bent.
Figure 6:
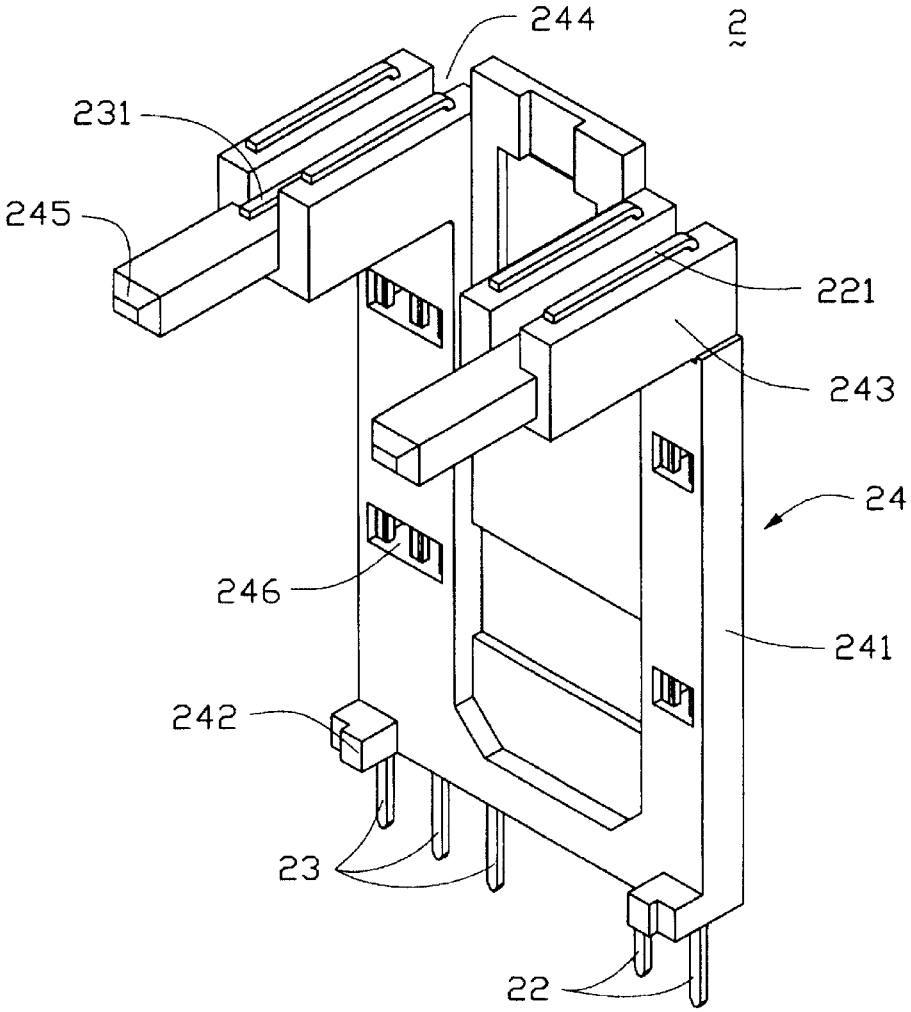
FIG. 6 is a prospective view of a molded subassembly of the electrical connector, wherein soldering sections of connections are bent.

Referring to FIGS. 5 and 6, the molded assembly 2 has a plastic part 24, a first connection 22 and a second connection 23 respectively molded in the plastic part 24. The plastic part 24 has a body portion 241, opposite protrusions 242 protruding forwardly from a lower portion of the body portion 241, and a pair of supporting posts 243 protruding horizontally from an upper portion of the body portion 241. Each supporting post 243 has a positioning post 245 extending from a free end of the supporting post 243. Each supporting post 243 defines a channel 244 in a middle portion thereof. Referring to FIGS. 4*a*–4*c*, the first and second connections 22, 23 respectively have soldering sections 221, 231, engaging sections 222, 232, and retaining sections 223, 233 connecting the soldering sections 221, 231 and engaging sections 222, 232.

Referring to FIGS. 1–8, in assembly, the engaging portions 712 of the grounding terminal 71 engage with corresponding recesses 812 of the first housing 81, and the grounding tails 713 of the grounding terminal 71 abut against lateral sides of the vertical PCB 83. The contact array assembly 9 of the subassembly 7 projects through the first groove 541 into the first cavity 511 of the main housing 5, the grounding terminal 71 projects through the second groove into the second cavity 512 of the main housing 5, the locating posts 522 of the main housing 5 engage with corresponding keys 811 of the first housing 81 of the subassembly 7, the bearing portions 523 of the main housing 5 are sustained by the ribs 813 of the main first housing 81. The leads 611, 621 of the bi-color LED 61 and single color LED 62 respectively project through corresponding passages 532 of the main housing 5. The bi-color LED 61 and the single color LED 62 are respectively received in corresponding apertures 531 of the main housing 5. The stacked USB 4 is received in the second cavity 512 of the main housing 5. The plastic part 24 of the molded assembly 2 is assembled to the main housing 5 and subassembly 7. The positioning posts 245 are positioned in corresponding slots 543 of the main housing 5. The supporting posts 243 of the plastic part 24 are respectively supported by upper edges of the bearing portions 523 of the main housing 5. The protrusions 242 of the plastic part 24 are received in corresponding depressions (not labeled) of the first housing 81 of the magnetic assembly 8. The retaining sections 223, 233 of the first and second connections 22, 23 are exposed from the corresponding openings 246 of the plastic part 24, so that the space between every two retaining sections can be controlled from the opening 246. As the leads 612, 622 of the bi-color LED 61 and the single color LED 62 is a little lower than top surfaces of the supporting posts 243 of the plastic part 24, the soldering sections 221, 231 of the first and second connections 22, 23 respectively electrically connect with corresponding free ends 622, 612 of the leads 611, 621 tightly. The LED receiving openings 321 of the shield 3 receive corresponding LEDs 6, the first opening 323 and USB opening 322 of the shield 3 are respectively aligned with corresponding first and second cavities 511, 512 of the main housing 5, and the mounting tabs 331 of side walls 33 of the shield 3 respectively engage with corresponding mounting holes 311 of the top wall 31 of shield 3.

Referring to FIGS. 4*a*–6, a method of making the first and second connections 22, 23 and a method of inserting the first and second connections 22, 23 with the plastic part 24 has following steps:

(a) stamping a metal sheet into a first edge 20, a second edge 21, and pairs of first and second connections 22, 23, the first pair of first and second connections 22, 23 respectively have connecting portions 25 respectively connecting the first and second connections 22, 23 to the second edge 21, and engaging portions 222, 232 respectively connecting the first and second connections 22, 23 to the first edge 20, the second pair of first and second connections 22, 23 respectively have connecting portions 25 respectively connecting the first and second connections 22, 23 to the first edge 20, and engaging portions 222, 232 respectively connecting the first and second connections 22, 23 to the second edge 21, the first and second pairs of the first and second connections 22, 23 are crossways stamped, each of the first and second connections 22, 23 has a soldering portion 221, 231 connecting with corresponding connecting portion 25, an retaining portion 223, 233 connecting the soldering portion 221, 231 to the engaging portion 222, 232;

(b) a first distance L1 between the first pair of the first and second connections 22, 23 having the connecting portions 25 connecting to the second edge 21 being equal to a second distance L2 between the second pair of first and second connections 22, 23 having the connecting portions 25 connecting to the first edge 20;

(c) severing the connecting portions 25 of the first pair of the first and second connections 22, 23 from the first edge 20, and severing the connecting portions 25 if the second pair of the first and second connections 22, 23 from the second edge 21 at the same time;

(d) insert molding the first and second pairs of the first and second connections 22, 23 in corresponding plastic parts 24, then severing the first edge 20 and second edge 21 and the connecting portions 25 from the first and second pairs of the first and second connections 22, 23;

(e) bending the first and second soldering sections 221, 231 of the first and second connections 22, 23 are bent toward corresponding supporting posts 243 of the plastic part 24 and extending horizontally and forwardly, the middle soldering sections 231 of the second connection 23 being bent and received in the channel 244 of the plastic part 24.

In use, the electrical connector 1 is disposed on a PCB of a peripheral equipment (not shown), the grounding tabs 333 engaging with the PCB of the peripheral equipment, the contacts 82 of the subassembly 7 engage with proper circuit traces of the PCB of the peripheral equipment, and the grounding tabs 333 connect grounding circuit traces of the PCB of the peripheral equipment.

An advantage of the present invention over the prior art is that the left free end 612 of the bi-color LED 61 extends longer than the right free end 614, the middle free end 613 is not coplanar with the left and right free ends 612, 614, and one of the free ends 622 of the single color LED 62 extends longer the other. As a result, a process of soldering the leads 611, 621 of the LEDs 6 to the soldering sections 221, 231 of the first and second connections 22, 23, is less difficult and tedious, and the soldering joints will not bridge each other during the process, thus electrical short circuiting can be prevented.

The left free end 612 of the bi-color LED 61 connects with positive pole on the PCB of the peripheral equipment, the right free end 614 of the bi-color LED 61 connects with cathode on the PCB of the peripheral equipment. As the left free end 612 extends longer than the right free end 614, the bi-color LED 61 may be correctly assembled so that the left and right free ends 612, 614 connecting with proper electrodes.

Figure 10:
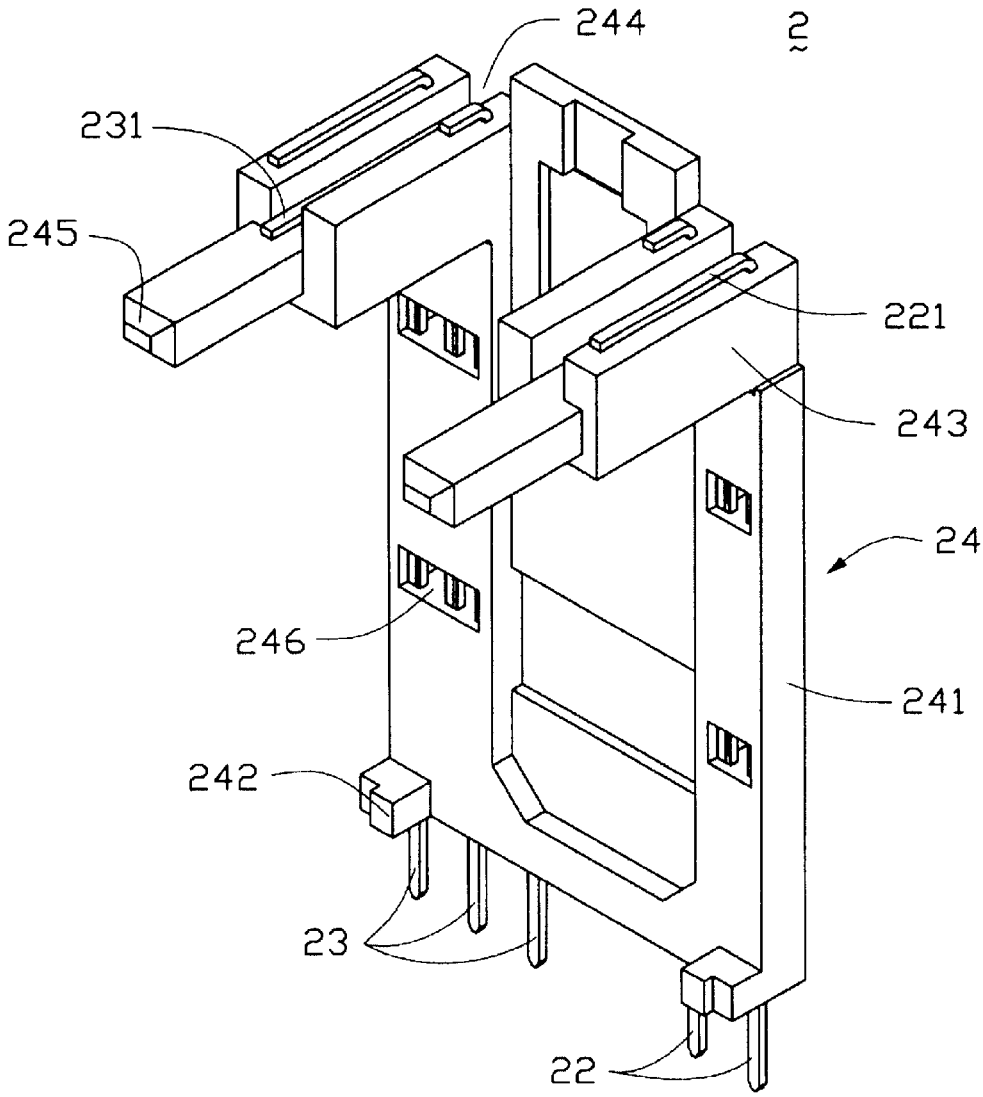
FIG. 10 is another embodiment of FIG. 5.

FIG. 10 shows another embodiment of the first and second connections 22, 23, the soldering portion of the second connection 23 for electrically connecting with the left free end 612 of the bi-color LED 61 extends longer than the soldering portion for electrically connecting with the right free end 614 of the bi-color LED 61, the soldering portion of the first connection 22 adjacent to a side edge of the body portion 241 extends longer than the other soldering portion thereof. Thus, if the LEDs 6 are wrongly assembled to the main housing 5 of the electrical connector 1, the longer leads of the LEDs 6 may not be soldered to the short soldering portions of the first and second connections 22, 23. As the longer leads of the LEDs connect with the shorter soldering portions of the first and second connections 22, 23, and the short leads of the LEDs 6 connect with the longer soldering portions of the first and second connections 22, 23, the insertion force is minimized remarkably.

It is to be understood, however, that even though numerous, characteristics and advantages of the present invention have been set forth in the foregoing description, together with details of the structure and function of the invention, the disclosed is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

a main housing, the main housing defining a first mating cavity;

a contact insert assembled into the first mating cavity including a contact module having a plurality of contacts having contact engaging portion extending into the mating cavity for electrically contacting with a mated connector; and at least an LED installed to the main housing, the LED including a luminophor, three leads, the three leads respectively having a first free end, a second free end, and a third free end, the second free end is on a different plane with the first and third free ends;

a contacting element having three pins, the pins respectively having first, second and third soldering portions respectively soldered to the first, second and third free leads of the LED; wherein the second soldering portion is on a different plane with the first and third soldering portions.

2. The electrical connector as claimed in claim 1, wherein the electrical connector has a subassembly, the subassembly having a vertical printed circuit board (PCB) and a contact array assembly disposed perpendicularly to the vertical PCB.

3. The electrical connector as claimed in claim 1, wherein the electrical connector has a molded assembly, the molded assembly having a plastic part and at least a connection insert molded in the plastic part, the connection having three soldering section respectively soldered to the three free ends of the leads of the LED.

4. The electrical connector as claimed in claim 3, wherein the plastic part has a supporting post, the supporting post defining a channel for receiving the second soldering portion of the contact element.

5. The electrical connector as claimed in claim 4, wherein the main housing has a slot, the plastic part has a positioning post extending from the supporting posts and received in the slot of the main housing.

6. An electrical connector, comprising:

a main housing, the main housing defining a first mating cavity;

a contact module received in the first mating cavity and having a plurality of terminals for electrically contacting with a mated connector;

at least an LED installed to the main housing, the LED including a luminophor, three leads, the three leads respectively having a first free end, a second free end, and a third free end, the first free end extends longer than the third free end; and a contacting element having three pins, the pins respectively having first, second and third soldering portions electrically connecting with a corresponding free end of the leads of the LED; wherein the first soldering portion connecting with the first free end of the LED extends shorter than the third soldering portion connecting with the third free end of the LED.

7. An electrical connector comprising:

an insulative housing;

a plurality of terminals disposed in the housing;

an indicating device attached to the housing, said indicating device including at least two closely spaced leads spatially rearwardly extending from a same level of an indicating body thereof; and a contact element including an insulative body attached to a rear portion of the housing and retaining therein at least two closely spaced pins with spaced solder portions at distal ends thereof, respectively; wherein said insulative body defines on an upper portion a step structure with two different levels thereof, the two solder portions are respectively located at said two different levels, and at least one of the leads defines an offset relative to the other to comply with the different levels, so that said two leads are able to be soldered on the corresponding solder portions, respectively, at different levels, without mutual contamination.

* * * * *